United States Patent [19]

Reinert

[11] Patent Number: 4,580,772

[45] Date of Patent: Apr. 8, 1986

[54] HOPPER AND FEEDER APPARATUS AND METHOD

[75] Inventor: Warren D. Reinert, Easton, Pa.

[73] Assignee: Bell & Howell Company, Phillipsburg, N.J.

[21] Appl. No.: 575,379

[22] Filed: Jan. 30, 1984

[51] Int. Cl.[4] ..... B65H 3/08

[52] U.S. Cl. ..... 271/100; 271/106; 271/144; 271/165

[58] Field of Search ..... 271/99, 100, 101, 102, 271/165, 166, 171, 106, 144

[56] References Cited

U.S. PATENT DOCUMENTS

| | | | |
|---|---|---|---|
| 2,325,455 | 7/1943 | Williams | 93/8 |
| 2,369,914 | 2/1945 | La Bombard | 271/101 |
| 3,380,353 | 4/1968 | Mittermayer | 271/100 |
| 3,844,551 | 10/1974 | Morrison | 271/99 |
| 3,934,868 | 1/1976 | Selak | 271/100 |
| 3,965,644 | 6/1976 | Stocker | 53/29 |
| 4,013,283 | 2/1977 | Tress et al. | 271/14 |
| 4,039,180 | 9/1977 | Stocker | 271/10 |
| 4,060,228 | 11/1977 | Tress et al. | 271/14 |
| 4,268,023 | 5/1981 | Anderson | 271/99 |
| 4,369,962 | 1/1983 | Spiro | 271/11 |

FOREIGN PATENT DOCUMENTS

| | | | |
|---|---|---|---|
| 0688469 | 3/1953 | United Kingdom | 271/100 |

*Primary Examiner*—Bruce H. Stoner, Jr.

*Assistant Examiner*—John A. Carroll

*Attorney, Agent, or Firm*—Griffin, Branigan, and Butler

[57] ABSTRACT

An envelope hopper (20) is capable of selectively handling stacks of short envelopes (SE), stacks of long envelopes (LE), or stacks of envelopes of intermediate dimensions. The envelope stack rests on a table frame (26) in such a manner that at least a portion of a bottommost envelope overhangs a breaker plate edge (32). At appropriate points in an machine cycle suction cups (64) rise from below a breaker plate (30) to attract the underside of the overhanging envelope and then fall to deflect the attracted envelope. Rotating arcuate surfaces (202) of segmented rollers (66) thereafter make contact with the underside of the deflected envelope. Cooperating rollers (72) are pivoted into a position to contact the upperside of the deflected envelope, to engage the deflected envelope between the rollers (72) and the driven segmented roller (66), and to apply a pressure which facilitates displacement of the envelope from the stack by the application of rotational motion from the segmented roller (66). The extent to which the envelope is fed from the stack and into awaiting gripper jaw (52) is dependent upon the extent of the motion of the rollers (72), as well as upon the distance separating the hopper (20) from transportation discharge means (54). The hopper (20) is further provided with an adjustable stack alignment guide (40) for accommodating envelope stacks of differing envelope sizes.

21 Claims, 12 Drawing Figures

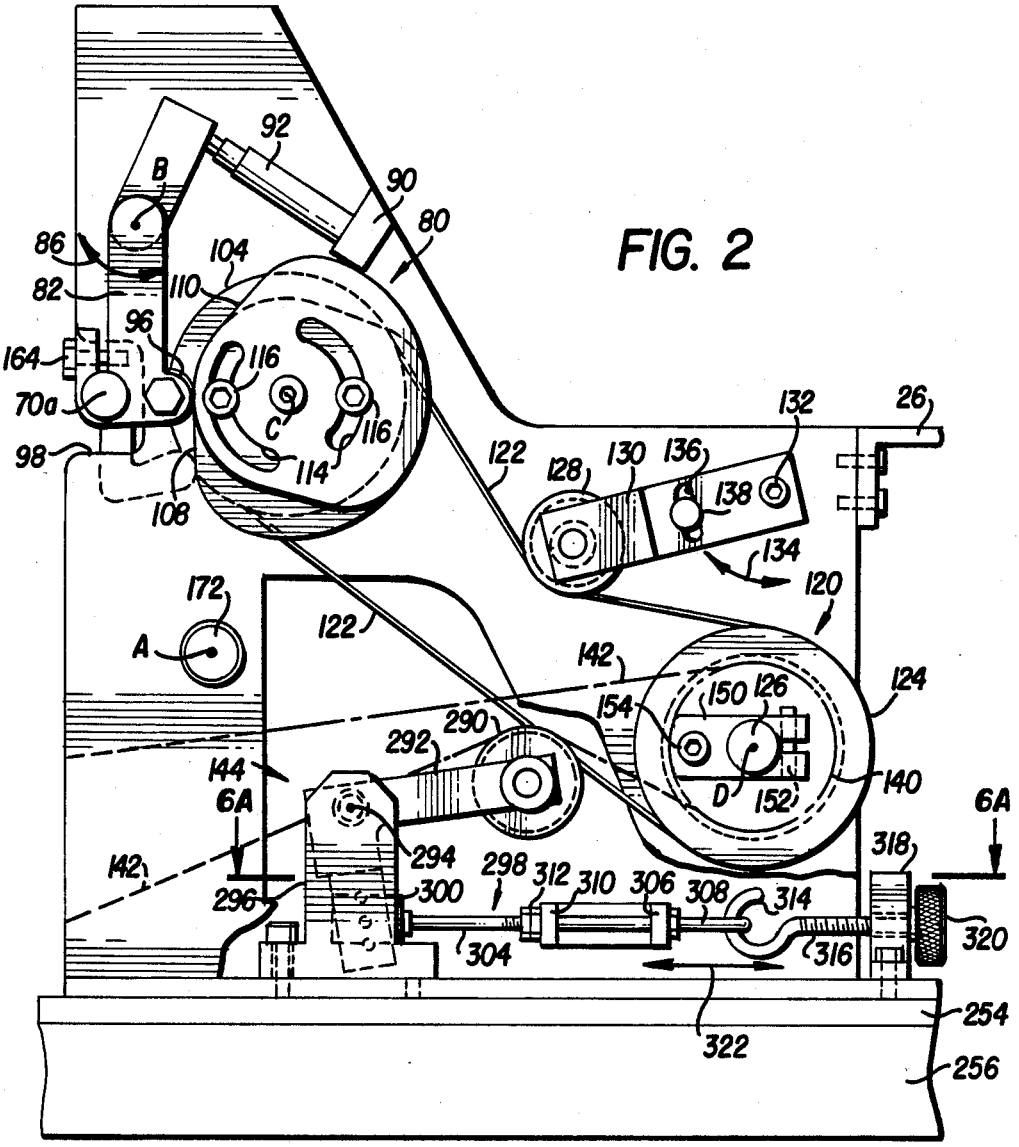
FIG. 2
FIG. 8A
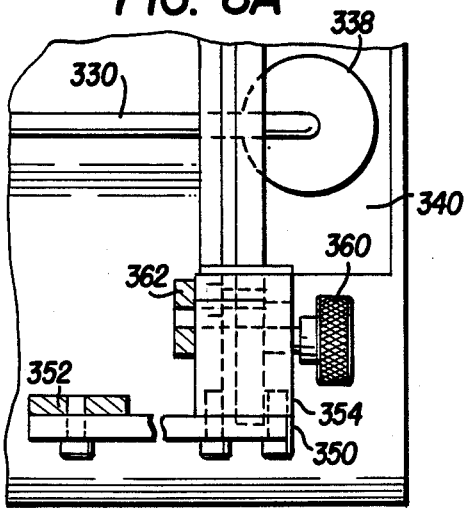
FIG. 8B
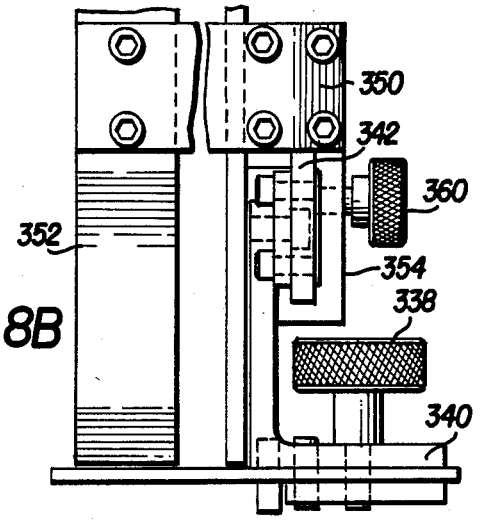

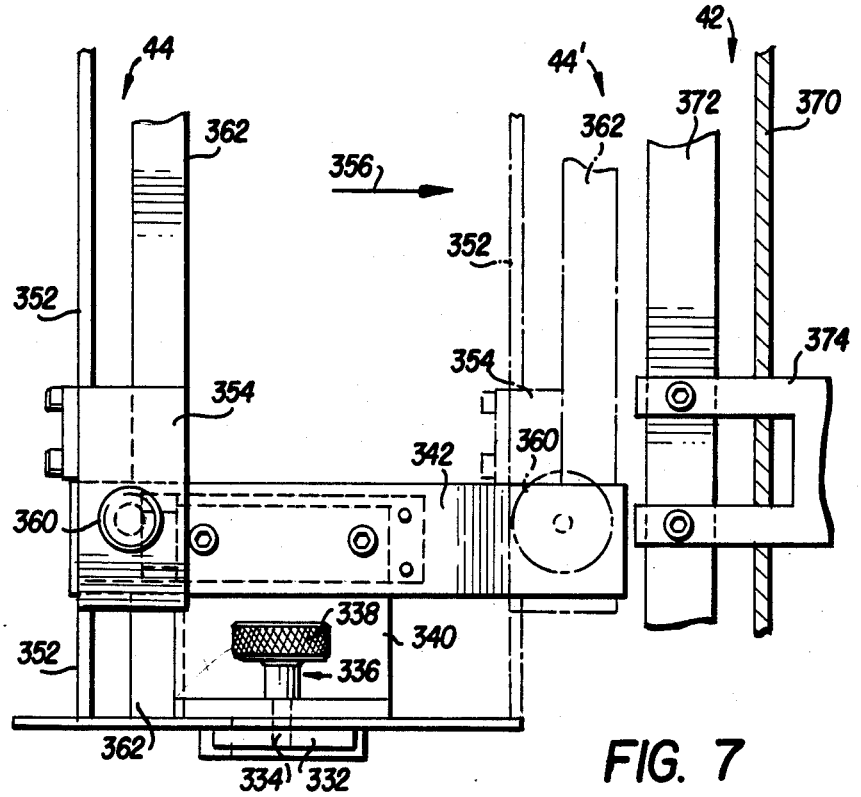
FIG. 7
FIG. 9
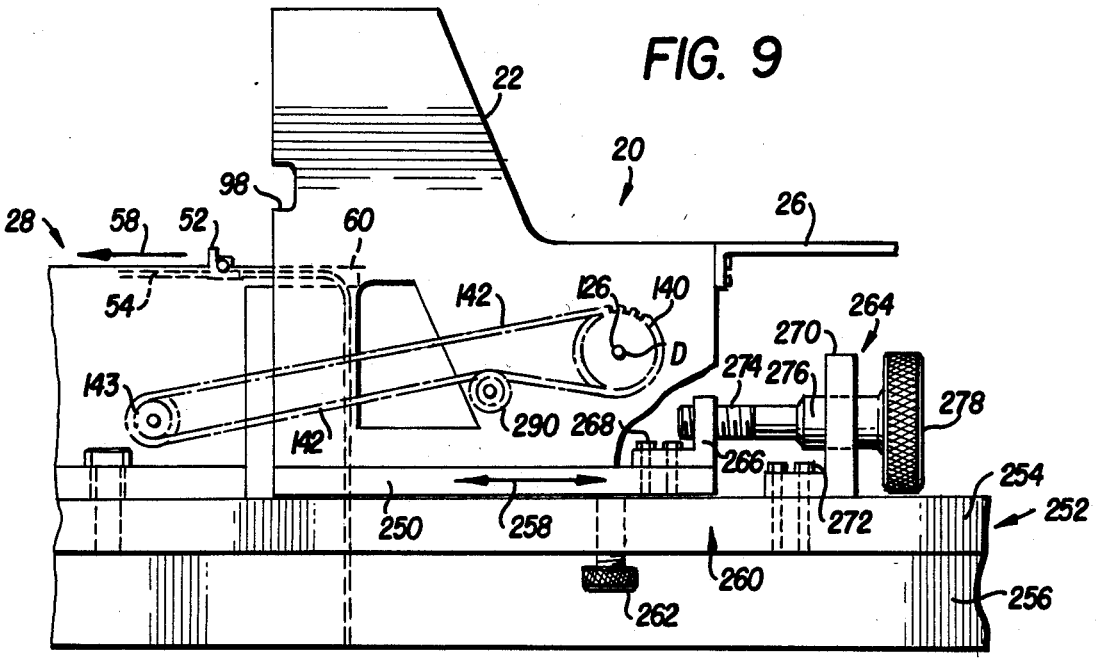

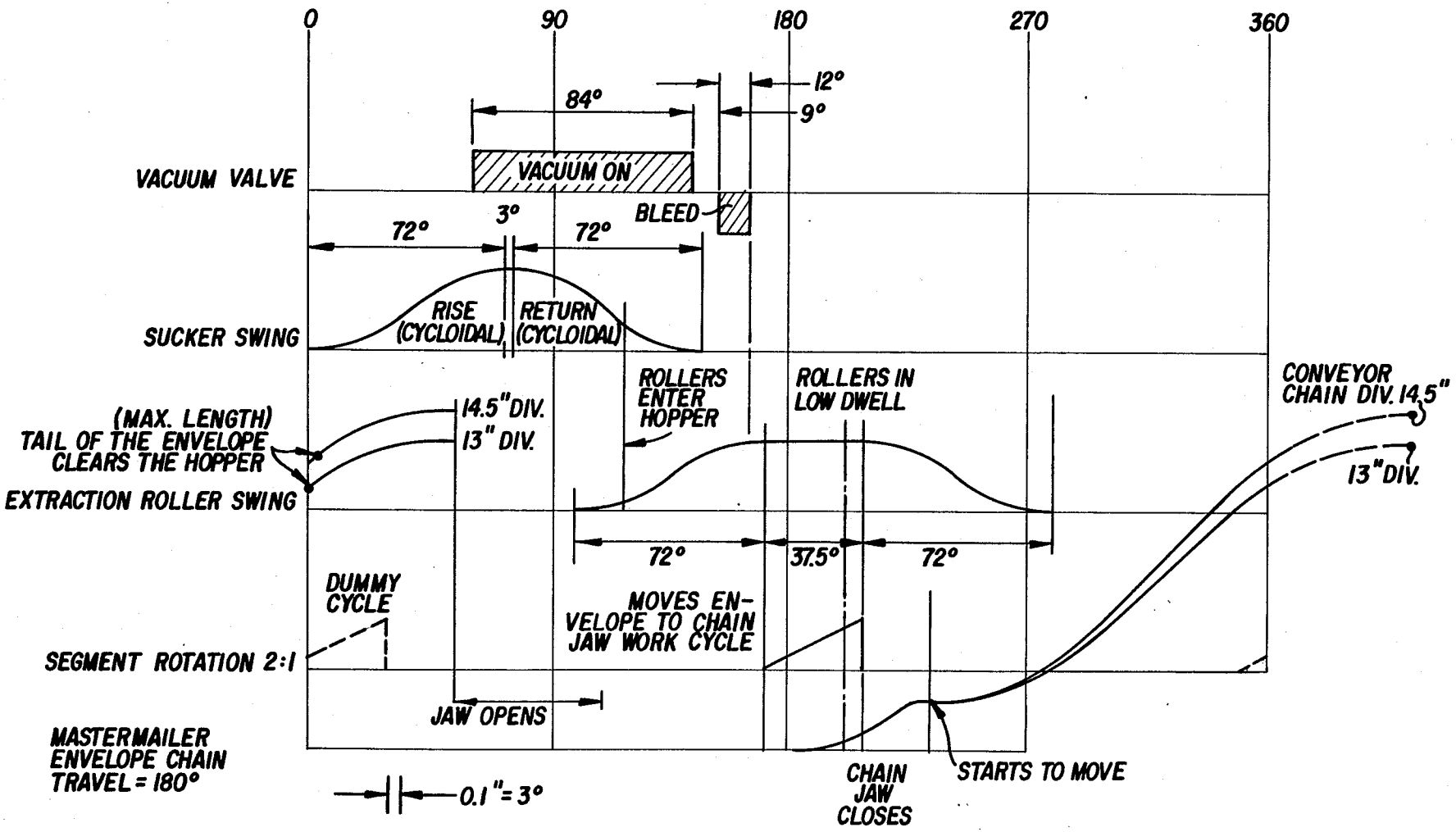
FIG. 10 TIMING CHART

HOPPER AND FEEDER APPARATUS AND METHOD

BACKGROUND OF THE INVENTION

This invention pertains to hoppers and feeders, and particularly to hoppers from which envelopes are extracted for use in a postal preparatory processing machine, such as an insertion machine or the like.

Traditional envelope hoppers have trouble handling both large envelopes (such as envelopes measuring on the order of 9.0 inches×12.0 inches or larger) and short envelopes (such as envelopes measuring on the order of 9.5 inches×4.0 inches or smaller). In one such prior art envelope hopper four vertical walls of a hopper are constructed to surround a stack of horizontally-oriented large envelopes. The bottom-most envelope of the stack rests on a horizontal breaker plate which extends from a back vertical wall toward but short of a front vertical wall. In this regard, the breaker plate terminates at a breaker plate front edge which lacks a few inches of reaching the front vertical wall. One or more suction mechanisms, positioned just below the plane of the breaker plate but between the breaker plate front edge and the front vertical wall, (function to reflect downwardly at least a portion of the bottom most envelope which is lying on and overhanging the breaker plate of the hopper) so that the bottom-most envelope can be engaged by appropriate gripper means situated proximate the front of the hopper; be extracted from the hopper; and, be transported away from the hopper for downstream postal preparatory processing.

In the hopper described above small envelopes are loaded with their major dimension parallel to the front vertical wall, and hence parallel to the breaker plate front edge. Since the breaker plate front edge is separated from the front vertical wall by a distance which is on the order of one-half the minor dimension of the small envelopes, a considerable amount of each small envelope overhangs the breaker plate front edge relative to the entire small envelope. When a stack of small envelopes are so loaded into such a hopper, the small envelopes tend not to lie horizontally, but instead tend to tip over the breaker plate front edge so that the envelopes in the stack are inclined at an acute angle to the breaker plate. The inclined plurality of envelopes cause a jam when the gripper means attempts to extract the bottom-most envelope.

Since the aforedescribed hopper has trouble in handling small envelopes, various prior art hoppers have been specially constructed to handle small envelopes. Unfortunately, these special hoppers do not handle large envelopes with equal facility. One type of prior art special hopper comprises two sets of vertical rods, each set positioned in parallel relationship along the major dimension of a space corresponding to a small envelope. Each set of rods has mounted thereto a horizontal ledge which faces and is coplanar with the ledge of the other set of rods. The major dimensional edges of a bottom-most envelope rest upon these ledges. Other envelopes are stacked upon the bottom-most envelope and between the vertical rods. A mechanism is situated below the plane of the ledges. When suction is applied, the formerly horizontally-oriented bottom-most envelope is bowed downwardly and eventually entirely sucked onto a planar surface parallel to but beneath the ledges. A reciprocating pusher mechanism (travelling from behind the hopper in a direction parallel to the major dimension of the small envelope) moves toward the envelope (which has been sucked beneath the stack); contacts the envelope; and, pushes the envelope into the jaws of awaiting gripper means in front of the hopper. This type of prior art envelope hopper works well for small envelopes which have sufficient beam strength across their minor dimension. If, however, the two sets of vertical rods defining the envelope stack become sufficiently displaced from one another in order to accommodate larger envelopes, the large envelopes sag due to the lack of beam strength characterizing such envelopes. A stack of sagging large envelopes precludes the pusher mechanism and gripper from functioning effectively.

Yet another type of prior art hopper specially adapted to handle small envelopes comprises a shuttle feed mechanism. The shuttle feed mechanism includes an essentially rectangular horizontal plate which reciprocates in its horizontal plane in a direction from the back of the hopper toward the front of the hopper. One of the concerns on the leading edge of the shuttle plate is truncated to define a triangular space. When the shuttle plate is in a position nearest the back of the hopper, a stationary first suction mechanism lies below the triangular space. The stationary first suction mechanism serves to deflect downwardly a corresponding corner of the bottom-most small envelope. A second suction mechanism situated on the other corner of the leading edge of the shuttle place also engages the bottom-most envelope and travels with the shuttle plate as the plate and bottom-most envelope held by the shuttle plate are advanced to the front of the hopper by the motion of the reciprocating shuttle plate. At the front of the hopper the appropriate gripper means engages the advanced envelope in like manner as described above and transports the advanced envelope away from the hopper. While the shuttle plate of this second type of envelope hopper functions well to extract small envelopes, the shuttle plate does not have enough suction to both attract a large envelope and cause the large envelope to reciprocate therewith in the direction of the gripper means.

In view of the foregoing, an object of this invention is the provision of an envelope hopper which handles both large and small envelopes with equal facility.

SUMMARY OF THE INVENTION

An envelope hopper is capable of selectively handling stacks of short envelopes, stacks of long envelopes, or stacks of envelopes of intermediate dimensions. The envelope stack rests on a table frame in such a manner that at least a portion of a bottom-most envelope overhangs a breaker plate edge. At appropriate points in an machine cycle suction cups rise from below a breaker plate to attract the underside of the overhanging envelope and then fall to deflect the attracted envelope. Rotating arcuate surfaces of segmented rollers thereafter make contact with the underside of the deflected envelope. Cooperating rollers are pivoted into a position to contact the upperside of the deflected envelope, to engage the deflected envelope between the rollers and the driven segmented roller, and to apply a pressure which facilitates displacement of the envelope from the stack by the application of rotational motion from the segmented roller. The extent to which the envelope is fed from the stack and into an awaiting gripper jaw is dependent upon control means which govern the motion of the rollers, as well as upon means provided to selectively adjust the distance separating the hopper from transportation discharge means. The hopper is further provided with adjustable stack alignment guide means for accommodating envelope stacks of differing sizes.

BRIEF DESCRIPTION OF THE DRAWINGS

The foregoing and other objects, features, and advantages of the invention will be apparent from the following more particular description of preferred embodiments as illustrated in the accompanying drawing in which reference characters refer to the same parts throughout the various views. The drawings are not necessarily to scale, emphasis instead being placed upon illustrating the principles of the invention.

FIG. 2 is a partial side view of the hopper of FIG. 1;

FIG. 7 is a partial rear view of a stack alignment guide means included in a hopper according to an embodiment of the invention;

FIGS. 8A and 8B are partial top and side views, respectively, of portions of the stack alignment guide means of FIG. 7;

FIG. 9 is a partial side view of a hopper according to an embodiment of the invention; and, FIG. 10 is a timing diagram depicting the operation of a hopper according to an embodiment of the invention.

DETAILED DESCRIPTION OF THE DRAWINGS

Figure 1:
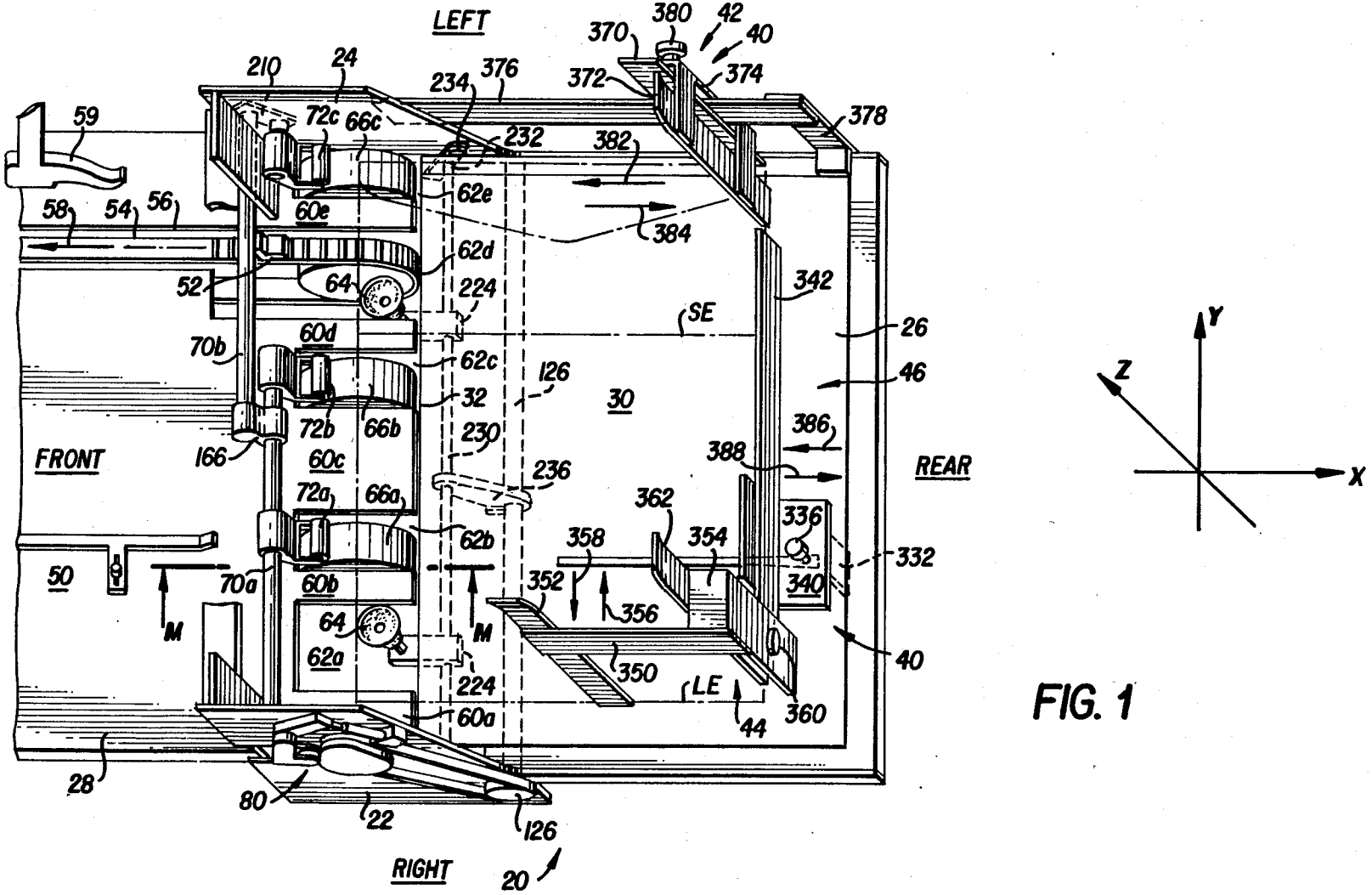
FIG. 1 is a perspective view showing a hopper according to an embodiment of the invention.

FIG. 1 shows a hopper and feed apparatus 20 which comprises right vertical side frame member 22 and a left vertical side frame member 24; an essentially horizontally-oriented stack-support table frame member 26; and, an essentially horizontally-oriented discharge table 28. The stack support table frame 26 has a horizontal breaker plate 30 mounted thereon. The breaker plate 30 has an edge 32 which is parallel to the Y axis as shown in FIG. 1.

Mounted in a manner described more particularly herein on the table frame 26 are stack alignment guide means denoted generally as 40. The stack alignment guide means comprise left side guide means 42; right side guide means 44; and, rear guide means 46.

The discharge table 28 has a table top 50 along which articles, such as envelopes, are transported after being fed from the hopper. In this respect, and as shown in FIG. 9 as well as in FIG. 1, a plurality of gripper jaws 52 are positioned at periodic intervals on an indexed chain 54. Chain 54 is driven in timed relationship with other facets of the hopper 20 by a sprocket 55 (see FIG. 3). The table top 50 has a channel 56 formed therein to accommodate, the chain 54 in the elevated portion of its path of travel along the table top 50. The chain 54 is driven so as to transport envelopes away from the hopper in the direction shown by arrow 58. Envelope opening means including a plough 59 are positioned on the table top 50 for opening envelopes which are fed from the hopper 20 and transported by chain 54.

The top 50 of discharge table 28 also has a plurality of rectangular-like peninsula portions 60*a*, 60*b*, 60*c*, 60*d*, and 60*e* which extend generally in the direction toward the stack-support table frame 26 of the hopper 20. In this respect, each peninsula 60 extends to a point just shy of the breaker plate edge 32 in the sense of the X axis. As seen hereinafter, the distance along the X axis separating the peninsulas 60 and the breaker plate edge 32 is selectively adjustable. The table top 50 and peninsulas 60 extending therefrom are not as high in the sense of the Z axis as the stack-support table frame 26, so that a vertical drop exists between the breaker plate 30 and the peninsulas 60.

Between the peninsulas 60 of the discharge table top 50 are essentially rectangular openings 62. In this respect, between peninsulas 60*a* and 60*b* is opening 62*a;* between peninsulas 60*b* and 60*c* is opening 62*b;* and so forth. The openings 62*a* and 62*d* are sized to accommodate deflection means, shown as sucker cups 64. As seen in hereinafter, the sucker cups are adapted to rotate upwardly into the plane of the breaker plate 30 and to attract thereto a portion of an envelope overhanging the breaker plate edge 32.

The openings 62*b*, 62*c*, and 62*e* are sized to accommodate segmented roller means 66, three such segmented rollers (66*a*, 66*b*, and 66*c*) being shown in FIG. 1. The structure and operation of these segmented roller means 66 are described below in further detail. The opening 62*d* also accommodates a portion of the chain 54 during a portion of its path of travel in which the chain 54 travels between peninsulas 60*d* and 60*e*.

Mounted between the vertical side frame members 22 and 24 is shaft means 70 including a first shaft segment 70*a* and a second shaft segment 70*b*. Connected to the shaft means 70 are rollers 72 which, as seen hereinafter, cooperate with segmented rollers 66. Accordingly, three such rollers 72 (namely, rollers 72*a*, 72*b*, and 72*c*) are shown in FIG. 1. The rollers 72 are suspended from the shaft means 70 by means hereinafter described for cooperation with the segmented rollers 66. In contrast to the segmented rollers 66, the rollers 72 are free rollers and are not driven.

Mounted on the right vertical side frame member 22 is control means indicated as 80 in FIG. 1 and better seen in FIG. 2. Control means 80 is used to control the pivotal motion of rollers 72 about a pivot point or axis B. Shaft means 70 to which each roller 72 is attached is carried by a follower arm 82 included in the control means 80. In particular, shaft 70*a* is accommodated in an aperture on the left hand side (as seen in FIG. 2) of the distal portion of the follower arm 82 by a fastener 84. As seen with reference to FIGS. 1 and 3, for example, the follower arm 82 is rotatable about axis B in the directions depicted by arrow 86.

Figure 4:
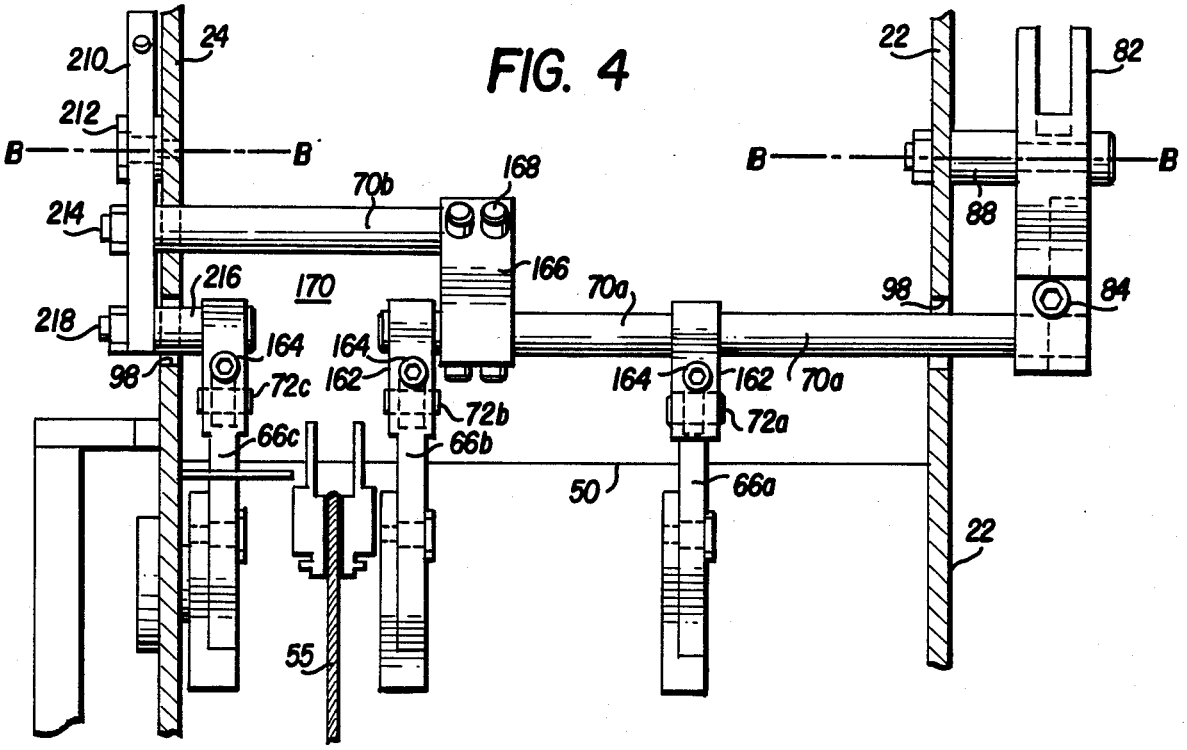
FIG. 4 is a partial front view of the hopper of FIG. 1.

As shown in FIG. 4, the follower arm 82 is connected to the side frame 22 by an appropriate fastener 88 along axis B in a manner which permits the follower arm 82 to pivot about axis B. The upper end of the follower arm 82 is biased towards a flange 90 integral with the side frame 22 by a appropriate biasing means, such as compression spring 92.

As described above, the distal end of the follower arm 82 has mounted on the left side thereof the shaft 70*a*. On the right side of the distal end of the follower arm 82 is mounted a follower roller 96. A niche 98 is cut out of each vertical side frame member (such as member 22 as shown in FIG. 2) to accommodate the rocking motion of shaft 70*a* as governed by the control means 80.

The control means 80 further comprises cam means, particularly a split cam including a first cam 100 and a second cam 102. Cams 100 and 102 are mounted in side-by-side relationship and adapted to rotate about a common axis C. A circular timing sprocket 104 is positioned between the cam means and the right vertical sidewall 22 and is also adapted to rotate about the axis C. The cam 102 is outermost with respect to the axis C. That is, the first cam 100 is axially positioned between the timing sprocket 104 and the second cam 102.

Each cam of the control means 80 has a surface or lobe thereon for controlling the movement of the rollers 72. Cam 100 has a cam surface 108 which controls the duration of the time in which the roller 72 travels in the counter-clockwise direction (as depicted by arrow 86) about axis B toward the counter-clockwise-rotating segmented roller 66. Cam 102 has a cam surface 110 which controls the duration of time in which the roller 72 travels in a clockwise direction (in the direction of arrow 86) about axis B away from the segmented roller 66. In general the follower roller 96 follows whichever of the cams 100 and 102 has a greater radial dimension between the roller 96 and axis C. The cams 100 and 102 are so oriented that the follower roller 96 on follower arm 82 rides on cam surface 110 of cam 102 after riding on cam surface 108 of cam 100. Thus, the cam means included in control means 80 rotate in the counter-clockwise direction.

The control means 80 also include means for adjusting the angular orientation of the cam 102 about the axis C. Cam 102 has two arcuate channels 114 at equal radial distances from the axis C. Each arcuate channel 114 extends through the width of cam 102. Each channel 114 is adapted to receive therein cam fastening or locking means 116 which extend through each channel 114. Each fastener 116 has a polygonal (preferably hexagonal) shaped head adapted to bear against the side of cam 102. Each fastener 116 further has a threaded shaft which is received in an appropriate counter-threaded bore properly aligned in cam 100.

As mentioned before, the cam means 80 rotates in a counter-clockwise direction. To this end, the sprocket 104 rotates in a counter-clockwise direction since it is connected to an intermediate driving means 120 by transmission means such as chain 122. The intermediate driving means 120 comprises a circular sprocket 124 adapted to engage the chain 122. In this regard, sprocket 124 is semi-circumferentially embraced by chain 122. The sprocket 124 is mounted on a counter-clockwise rotating shaft 126. Shaft 126 rotates about axis D.

The tension on chain 122 is adjustable by selecting an appropriate position for a tensioning sprocket 128. Sprocket 128 is mounted on a tensioning arm 130 adapted to pivot about pivot point 132 so as to selectively travel in an arcuate path as indicated by arrow 134. An arcuate channel 136 on the tensioning arm 130 receives a fastening means or locking means 138 which, when tightened, secures the tensioning arm 130 in a fixed position.

The intermediate driving means 120 further comprises a second sprocket 140 also mounted on the shaft 126. Sprocket 140 is semi-circumferentially engaged by transmission means such as chain 142 which connects the intermediate driving means 120 with primary driving means 143 (See FIG. 9). Tensioning adjustment means (generally indicated as 144) for chain 142 is described further herein.

Means for adjusting the angular orientation of cam 100 about axis C comprises a clamp 150 which is used to selectively lock sprocket 124 to the shaft 126 so that the sprocket 124 (and hence the chain 122 and the cam means) rotates as shaft 126 rotates. Fastening or locking means 152 enable the clamp 150 to be selectively loosened and tightened with respect to the shaft 126. Clamp 150 is secured to the sprocket 124 by suitable fastening means (such as fastener 154).

Figure 3:
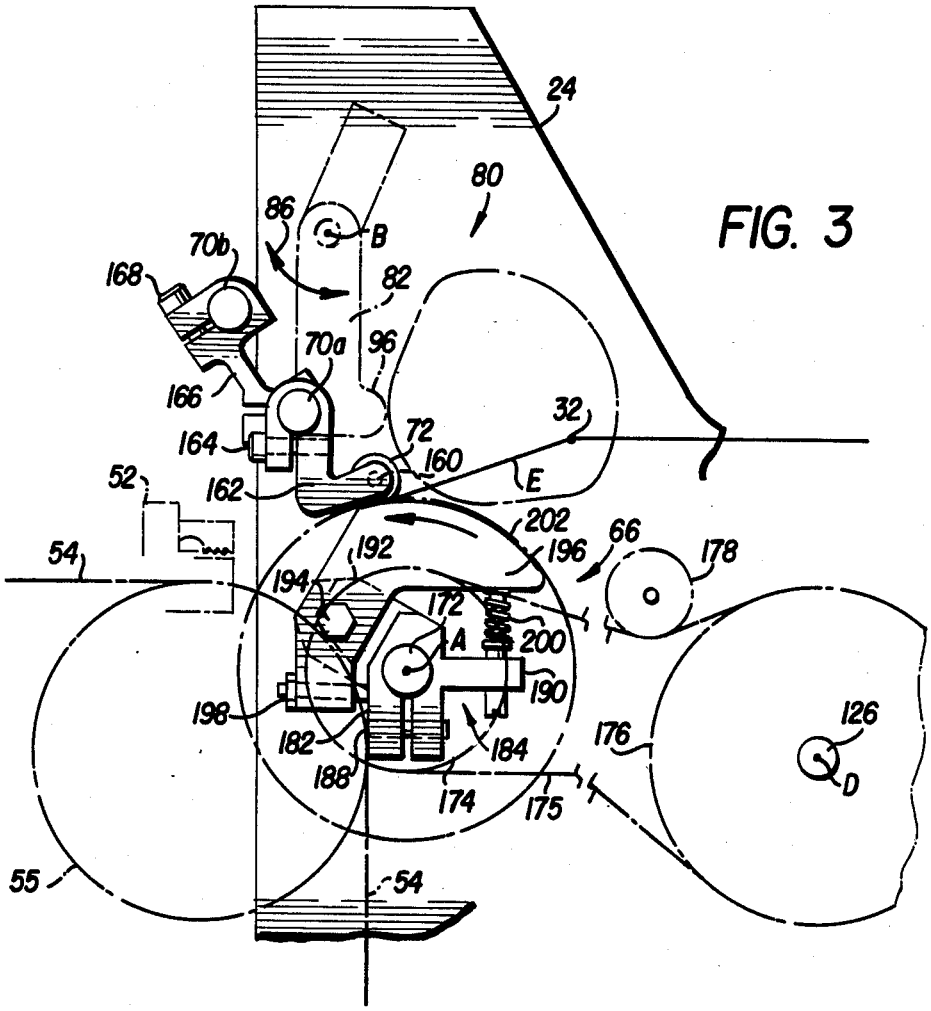
FIG. 3 is a partial sectional view taken along the line 3—3 of FIG. 1.

FIG. 3 shows in broken lines the follower arm which pivots about axis B. As described above, the follower arm 82 carries the shaft segment 70*a*. As the following roller 96 follows the cam means included in control means 80, the shaft 70*a* (and hence the roller 72) moves in the direction of arrow 86.

FIG. 3 further shows a roller 72 which cooperates with a corresponding segmented roller 66. The roller 72 is mounted for free rotation about a shaft 160. Each end of the shaft 160 is engaged by arms of a bracket 162. A fastener 164 locks the bracket 162 onto shaft 70*a*. At its lower extent the bracket 162 is essentially L-shaped. When the roller 72 is at is furthest extent of counter-clockwise travel in the direction of arrow 86, the base of the bracket 162 is inclined slightly upwardly at an acute angle with respect to the horizontal.

As indicated above, shaft means 70 comprise shaft segment 70*a* and segment 70*b*. Segment 70*b* is slightly offset from segment 70*a* and coupled thereto by a coupling bracket 166. Coupling bracket 166 is secured to the shaft 70*b* by appropriate locking means, such as fastener 168. Shaft segment 70*b* is offset from segment 70*a* so that a clearance 170 is provided between roller 72*b* and 72*c*. The clearance 170 facilitates the extraction of an envelope from the hopper by gripper jaw 52 in such a manner that envelope opening means positioned downstream on the table 50 can commence the opening the envelope flap without obstructions which would otherwise be presented by a shaft in the clearance 170.

FIG. 3 also shows one of the segmented rollers 66. Segmented rollers 66*a* and 66*b* are mounted as hereinafter described on a commmn horizontally-extending shaft 172. Although not illustrated as such, roller 66*c* is mounted on a separate horizontally-extending shaft which is coaxial with shaft 172. A gap in the neighborhood of the opening 62*d* separates the shafts upon which rollers 66 are mounted to accommodate the chain 54.

As further seen in FIG. 3, shaft 172 has a sprocket 174 mounted thereon. A driving chain 175 extends semi-circumferentially around the sprocket 174 and also semi-circumferentially around a third sprocket 176 mounted on the rotating shaft 126 having axis D. The diameters of the sprockets 174 and 176 are relatively sized so that the sprocket 174 rotates twice for each revolution of sprocket 176. A tensioning sprocket 178, similar in function and mounting to sprocket 128 described earlier, maintains an appropriate tension on the chain 175. Although not illustrated herein, it should be understood that the shaft upon which roller 66*c* is mounted has a sprocket analogous to sprocket 174 mounted thereon, so that a chain analogous to chain 175 can extend therearound and around a sprocket like sprocket 176 on shaft 126.

The segmented roller 66 comprises an essentially C-shaped portion 182 of a bracket 184 locked to shaft 172 by a fastener or locking means 188. Shaft 172 has axis A as its axis rotation. The bracket 184 has an arm perpendicularly extending therefrom. The bracket 184 also has an extension member 192 integral with the C-shaped portion 182 thereof. The extension member 192 is adapted to receive a fastener 194. The fastener 194 connects the bracket 184 in pivotal relationship to a circular segment member 196. A first end of the segment member 196 is counter-threaded to receive a stop limiting means, particularly a threaded fastener 198. The position of a nut on the threaded fastener 198 determines the distance separating the segment portion 196 and the bracket 184 at the stop means 198. An opposite end of the segment member 196 has resilient means such as compression spring 200 connected thereto to bias the segment member 196 to the perpendicular arm 190 of the bracket 184. The segment member 196 has an arcuate surface 202. Although segment member 196 is pivotable about a fastener 194, it is generally urged by the stop limiting means and compression spring 200 to a position whereby arcuate surface 202 travels the circular path about axis A. The compression spring 200 thus serves to protect against overloads in the event of multiple feeds or the like. When the segment member 196 is so positioned that the arcuate surface 202 generally travels a circular path about the axis A of shaft 172, the arcuate surface 202 is seen as subtending an angle of approximately 75° with respect to the axis A.

FIG. 4 shows a rotating arm 210 mounted on the opposite veritcal side frame 24 and adapted to pivot about the axis B. In this regard, the arm 210 is mounted to the sidewall 24 by a fastener 212 which permits rotation of the arm 210 about axis B. The arm 210 resembles the follower arm 82 in that it is adapted to receive shaft means 70 and a spring somewhat similar to compression spring 92 on arm 82. In particular, the arm 210 is adapted to receive in an aperture thereof shaft segment **70*b* and to secure the same thereto by fastener 214. The distal portion of the arm 210 has a horizontal extension 216 secured thereto by fastener 218. The horizontal extension 216, which functions much in the manner of shaft segment 70*a* and is coaxial therewith, has roller 72 secured thereto by a bracket 164** in the manner described above.

Figure 5:
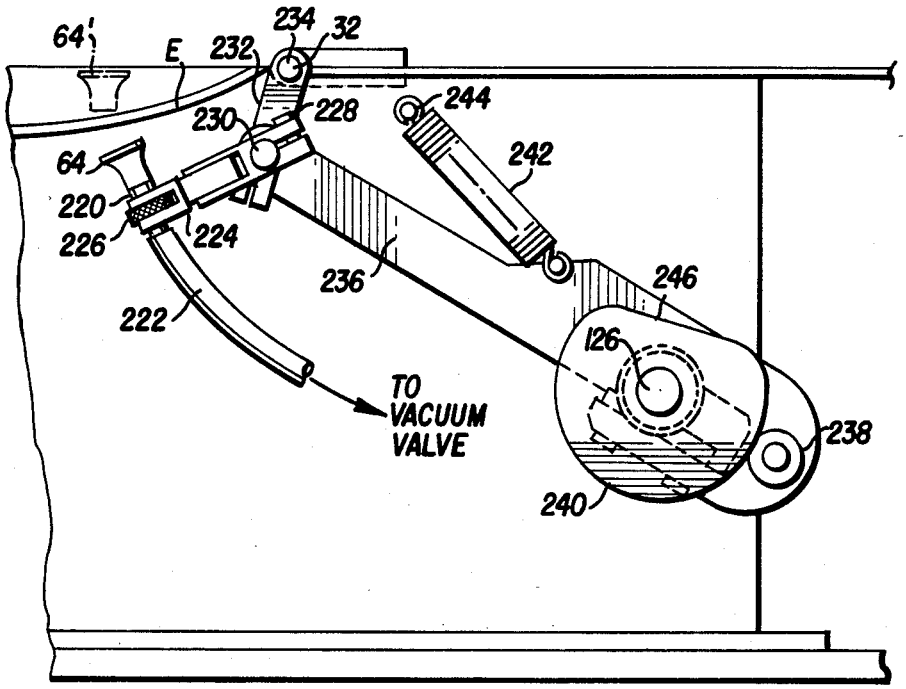
FIG. 5 is a partial side view of deflection means included in a hopper according to an embodiment of the invention.

FIG. 5 illustrates deflection means associated with the hopper 20. The deflections means includes a pair of sucker cups 64, one of which is shown in FIG. 5. Each sucker cup, 64 is mounted on a stem 220 connected by flexible tubing 222 to a vacuum valve (unillustrated). The stem 220 has a threaded exterior. The stem 220 extends through a circular opening in each of two arms of a first end of a bracket 224. The arms of the first end of the bracket 224 are separated by gap which accommodates an adustment ring 226. The adjustment ring 226 has its interior diameter counter-threaded to ride on stem 220. Turning of the adjustment ring 226 is used to adjust the position of the bracket 224 relative to the stem 220.

The second end of the bracket 224 is configured as a clamp and locked by fastener 228 onto a horizontal shaft 230. The horizontal shaft 230 runs essentially the width of the table 26 as seen in FIG. 1. At each side of the table 26 an end of the shaft 230 is held by a bracket 232 to a pivot point 234. When the table 26 is in a retracted position, the pivot point 234 on each side of the table 26 is aligned in all directions with the breaker plate edge 32 as seen in FIG. 5. The positioning of the pivot point 234 in FIG. 1 relative to the breaker plate edge 32 has been slightly displaced to facilitate illustration of the bracket 232 and point 234.

Shaft 230 is connected by a reciprocating arm 236 through the rotating shaft 126 described above. A second end of the arm 236 has a follower roller 238 mounted thereon. Roller 238 has a circumferential point thereof in contact with the circumference of a cam 240. The cam 240 is mounted on the shaft 126. Arm 236 has a slot along its major axis to accommodate the shaft 126 so that the arm 236 can reciprocate about the shaft 126 in the manner about to be described. Resilient biasing means 242 connected to a sidewall connection point 244 urges the arm 236 leftward as shown in FIG. 5 so that the sucker cup is in the position shown by the broken lines 64' when the surface 246 of cam 240 is in contact with the follower roller 238. Otherwise, when the essentially circular load portion of cam 240 contacts the roller 238, the arm 236 is driven toward the right and the cup 64 is in the position shown by the solid lines in FIG. 5.

As seen in FIG. 9, at the bottom of each vertical side frame member is a horizontally extending flange 250. Flange 250, and thus the hopper 20, is situated on a foundation support 252 which comprises a horizontally extending flange 254 and a vertical support wall 256. The foundation support 252 comprises part of an overall aparatus system in which the hopper 20 is included. For example, the foundation support 252 is, in one embodiment, part of an automated in-line insertion machine which utilizes envelopes fed from the hopper 20. The foundation support 252 is so adapted that the position of the hopper 20 can be adjusted in either of the directions as indicated by the double-headed arrow 258. That is, hopper 20 and particularly the flange 250 is adapted to travel in the directions indicated by arrow 258. As understood with respect to the coordinate system of FIG. 1, motion in the directions indicated by the arrow 258 is along the X axis. The hopper 20 is restrained from travel along the Y axis by suitable means, including an unillustrated channel in flange 254 which extends along the X direction and is adapted to receive a complementary fitting tongue on hopper flange 250.

Displacement of the hopper 20 in the direction of the arrow 258 as indicated in FIG. 9 adjusts the distance of strategic hopper elements with respect to the transportation means 54 and gripper jaws 52 carried thereon. In particular, displacement of the hopper 20 in the directions of arrow 258 changes the location of such elements as, for example, (1) the breaker plate edge 32, and (2) the segmented roller 66 and the rollers 72 which are used to pull deflected bottom-most articles from the breaker plate 30 and feed the same to the transport mechanism 54. Displacement of the hopper 20 in this manner is a further control on the extent to which an article such as an envelope is fed to an awaiting gripper jaw 52.

Displacement of the hopper 20 in the directions indicated by arrow 258 is facilitated by adjustment means 260. Means 260 comprise one or more locking clamps 262 and a means 264 for translating rotational motion into linear displacement. The clamp 62 has a manually-engagable head and a threaded stem which extends through an aperture in the horizontal flange 254 of the foundation support 252 to selectively bear against the flange 250 of the hopper to lock the same in position. Loosening the clamp 262 permits an operator to adjust the means 264 so that the hopper 20 can be displaced in the directions of arrows 258.

The means 264 include a first inverted L-shaped bracket 266 (which is secured to the base of the hopper 20 by appropriate threaded fasteners 268) and a second inverted L-shaped bracket 270 (which is secured to the surface 254 by appropriate fasteners 272). The brackets 266 and 270 have apertures in their upstanding members, the apertures being aligned in the sense of the X asis as shown in FIG. 1. The aperture of bracket 266 is adapted to receive a threaded stem 274 of a rotatable member 276. The aperature in the upstanding member of bracket 270 is of a somewhat larger diameter to accommodate a correspondingly enlarged diameter portion of the rotatable member 276. The rotatable member 276 is further provided with a manually-engageable head 278. Rotation of the head 278 of rotatable member 276 causes the rotation of the threaded stem 274. Inasmuch as the bracket 270 is stationary and prevents the rotatable member 276 from displacement in the direction of the X axis, the threaded relationship of the stem 274 and the aperture in the upstanding member of bracket 266 causes the entire hopper 20 to be displaced in the directions of arrow 258 so that the distances separating the structural mechanisms included in the hopper 20 are adjustable with respect to the discharge table 28, and particularly the transport means 54 including gripper jaws 52 associated therewith.

Figure 6A:
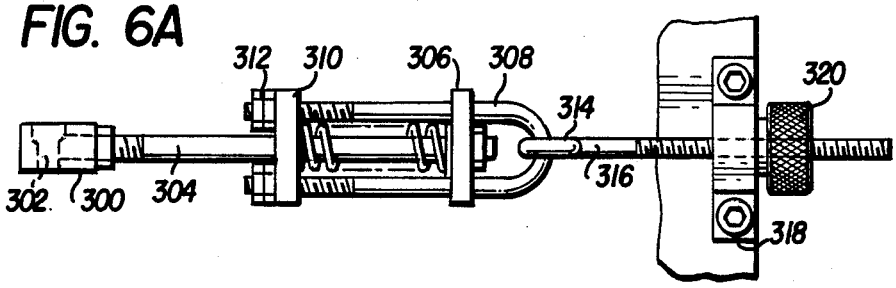
FIGS. 6A and 6B are partial top and side views, respectively, of tensioning apparatus included in a hopper according to an embodiment of the invention.
Figure 6B:
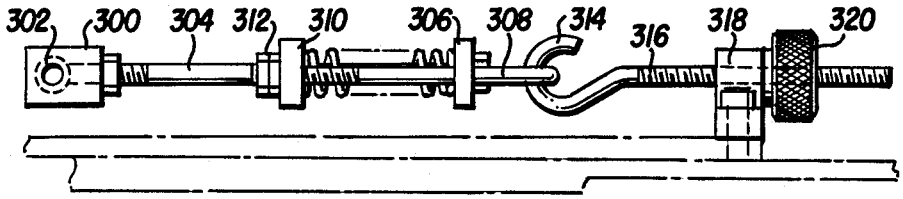

Referring back now to FIG. 2, the tension adjustment apparatus 144 includes a sprocket 290 rotatably mounted on an L-shaped arm 292. The arm 292 pivots about a point 294, the point 294 being fixed to the base of the hopper 20 by a pedestal 296. The end of the arm 292 which does not carry the sprocket 290 is adapted to carry a tension take-up linkage mechanism generally indicated as 298, also shown in FIGS. 6A and 6B. In particular, the tension take-up mechanism 298 comprises a block 300 which has an aperture 302 extending horizontally therethrough. A shaft about which the block pivots extends through the aperture 302 and is engaged by the lower end of arm 292.

Block 300 is also counter-threaded to engage a threaded first end of a connector member 304. The second end of the connector 304 extends through a central aperture of a plate 306. Plate 306 has three apertures aligned in the sense of the Y axis of FIG. 1. The two outer apertures on plate 306 receive leg portions of an elongated essentially U-shaped threaded member 308. The ends of the legs of U-shaped threaded member 308 extend through a second plate 310 which, except for position of placement, is identical to the plate 306. The ends of the legs of the U-shaped member 308 are secured to the plate 310 by appropriate fasteners 312.

A bent portion of the U-shaped threaded member 308 is engaged by a crook member 314. A stem portion 316 of the crook 314 is threaded and is received in an aperture of a pedestal 318. An internally counter-threaded knob 320 travels on the threaded stem 316 of crook 314. Manual adjustment of the knob 320 causes the crook member to travel in either of the directions indicated by arrow 322. That is, manual rotation of the knob 320 is translated into linear motion along the direction of the X axis as seen in FIG. 1. For example, clockwise rotation of the knob 320 pulls the crook member 314 rightwardly, pulling the U-shaped member 308, connector member 304, and block 300 rightwardly. Rightward displacement of the tension take up linkage 298 thus cause the L-shaped arm 292 to rotate in a counter-clockwise direction about pivot point 294, so that sprocket 290 travels in a counter-clockwise sense and higher relative to the pivot point 294 so as to takeup slack in the chain 142. Such an adjustment is needed when, for example, as seen in FIG. 9 to be a distance separating the shaft 126 and the driving means 143 is decreased as a result of the displacement in a leftward direction of the hopper 20 with respect to the foundation support 252 as described above.

FIGS. 7, 8A, and 8B further illustrates stack alignment guide means 40. The rear guide means 46 operates in conjunction with the slot 330 formed in the plane of the table 26. The slot 330 is an elongated slot extending in a direction essentially parallel to the X axis as seen in FIG. 1. A channel 332 is formed beneath the table top 26 in such a manner as to extend under the slot 330 throughout its length. The slot 330 and channel 332 formed thereunder are adapted to accommodate the stem 334 of a lock member 336 included in the rear guide means 46. The lock member has a manually-engageable head 338 which is rotatable to selectively tighten and thus secure a block member 340 (with which lock member 336 travels) against the table top at selected desired locations. Block 340 is essentially L-shaped with a base leg extending essentially horizontally. The base leg of the block 340 has a vertically extending aperture through which the stem 334 of lock member 336 extends, stem 334 extending further through the slot 330 and into the channel 332 to bear against a horizontal bottom surface of the channel 332. An upright leg of the block 340 has an elevated horizontal rail 342 connected thereto. One end of the rail 342 terminates just short of the left side guide means 42; the other end of the rail 342 terminates in a channel in the right guide means 44.

The right side guide means 44 includes an elevated horizontally-extending member 350 which is held aloft by a traveling block 354 adapted to ride on the rail 342 of the rear guide means 46. Horizontal-extending member 350 supports the vertical guide post 352. The traveling block 354 has a channel formed in a depending portion thereof to fit over the rail 342 so that the right guide means 44 can travel along the rail 342 in the direction of the Y axis (that is, either in the direction indicated by arrow 356 or arrow 358). Locking means 360 including a manually-engageable rotating head on a threaded shaft are received in an aperture of the block 354 so that the head of the shaft can extend into the channel formed by the block 354 and bear against the rail 342. The locking means 360 can thus be selectively loosened so that translation of the right guide means 44 in the manner described above can take place, and thereafter can be locked to secure the right guide means 44 in position. Also included in the right guide means 44 is a vertically extending post 362 secured to the block 354 and oriented to form a guide surface facing the front of the hopper 20.

The left side alignment guide means 42 comprised two vertically extending posts 370 and 372 arranged in the corner configuration and coupled together by a bracket 374. The bracket 374 allows the left side alignment guide means 42 to travel along an elevated horizontal rail 376. A first end of the rail 376 is connected to the left vertical side frame member 24 by appropriate fasteners; the second end of the rail 376 is held elevated by a stationary post 378. Locking means 380 including a manually-actuatable knob on a threaded stem is used to selectively tighten the bracket and post assembly to the rail 376 at a desired location along the rail 376.

OPERATION

In operation, the envelope stack alignment guide means 40 are adjusted to accommodate the size of envelopes to be included in the stack which is to rest on the stack-support table frame 26. For the sake of example, it will be assumed that the respective guide means including left side guide means 42, right side guide means 44, and rear guide means 46 have heretofore been in the position shown in FIG. 1 to accommodate a large envelope LE whose dimensions are shown in broken lines in FIG. 1. For the current example, however, it is desired to adjust the hopper 20 and particularly the stack alignmnent guide means 40 to accommodate a small envelope shown by the broken lines SE in FIG. 1. It will be recalled that heretofore prior art apparatus were not able to effectively handle both large and small envelopes.

The stack alignment guide means 40 included in the hopper 20 are adjusted to accommodate a stack of small envelopes SE in the following manner: The left side alignment guide means 42 is first adjusted to accommodate a corner of the envelope by loosening the locking means 380 associated therewith, sliding the guide means 42 (if necessary) in either of the directions indicated by arrows 382 or 384 to the desired position along the rail 376; and, tightening the locking means 380. The knob 336 on the rear guide 46 is likewise loosened; the block 340 (and hence the entire rear guide means 46) is moved either in the direction of arrows 386 or 388 with the stem 334 of the lock member 336 traveling in the slot 330 until the desired position with respect to the X axis is reached; and, the lock member 336 is tightened so that the stem 334 bears against the bottom of the channel 332. The right guide means 44 is moved in the direction of arrow 356 to assume the position shown in broken lines in FIG. 7. Movement in this manner of the right guide means 44 is facilitated by loosening of the locking means 360; sliding the right guide means 44 and particularly the block 354 along the rail 342 until the desired position is reached; and, tightening the locking means 360.

In the above regard, it is seen that the stack alignment guide means are so positioned that the major dimension of the small envelope SE lies along the X axis as seen in FIG. 1 and is thus perpendicular to the breaker plate edge 32 rather than parallel as in prior art devices. So positioned, the stack of small envelopes SE will not tip over the breaker plate edge 32 as might occur in prior art devices.

FIG. 10 illustrates the operation of the apparatus described hereinbefore with reference to particular points on a machine cycle. A machine cycle of 360 degrees is taken with reference to the rotational position of the primary drive means, particularly primary drive shaft 143 shown in FIG. 9. Hereinafter, degrees of interest of the machine cycle are simply designated DMC. Slightly after 0 DMC, cam surface 246 of cam 240 has roller 238 riding thereon so that arm 236 is displaced leftwardly and the sucker cup 64 rises to assume the position of the sucker cup 64' shown in broken lines in FIG. 5. Slightly before 72 DMC the vacuum valve turns on to apply suction through the sucker cup 64' to a portion of an envelope E which overhangs the breaker plate edge 32. At approximately 73 DMC through 75 DMC the sucker cup remains in the position of the broken line 64' of FIG. 5. Then, following the remainder of the cam surface 246 the roller 238 and arm 236 begin to move rightwardly so that the cup 64 gradually returns during approximately 75 through 147 DMC to the position shown in FIG. 5, carrying with it the attracted and deflected overhanging portion of the envelope E.

During 0 DMC through 180 DMC the segmented rollers 66 rotate once about their axis A. It will be recalled that rollers 66 rotate twice per machine cycle (that is, twice per 360 DMC). Of the 180 degrees of machine cycle required for each rotation, the arcuate surface 202 of the segmented roller 66 is in a position to potentially contact the underside of a deflected envelope E as seen in FIG. 3 for only about 37.5 DMC. During the first rotation of rollers 66 a dummy operation is performed since an envelope has not yet been deflected.

The follower roller 96 on follower arm 82 begins to ride on the cam surface 108 of cam 100 (see FIG. 2), causing the follower arm 82 and shaft means 70 carried thereby to travel in the counterclockwise direction (as indicated by arrow 86) about the axis B so that the roller 72 (mounted on the shaft means 70 in the aforedescribed manner) travels in toward the segmented roller 66 and contacts the upper side of the envelope E to keep envelope E deflected. For the embodiment shown in FIG. 10, at about 170 DMC the rollers 72 are at their furthest counterclockwise extent of travel and dwell for an adjustable duration of time. Also at about 170 DMC, segmented member 196 of the segmented roller 66 rotates such that the arcuate surface 202 contacts the underside of the deflected envelope E. The segmented member 196 thus begins the work of actually pulling the envelope E from the breaker plate 30 and from under the stack. Roller 72 applies a pressure which causes the envelope E to be gripped between the roller 72 and the segmented roller 66, particularly the segmented portion 196 of the segmented roller 66. That is, in this position the envelope E has its underside in contact with the segmented roller 66 (driven to rotate in a counterclockwise direction) and has its upperside contacted by the free rolling roller 72. Due to this engagement and the rotating motion of the segmented roller 66 the deflected envelope E is pulled away from the stack in which it had previously been included on breaker plate 30 to a position from which it can be engaged by gripper jaw 52 and transported away from the hopper 20 by the transport means 54. The dwell and subsequent clockwise travel of the rollers 72 are governed by follower roller 96 which first rides on cam surface 108 of cam 100 as described above and then rides on cam surface 110 of cam 102. Thus, while cam 100 is used to control the timing of entry of the rollers 72 into the hopper (counterclockwise direction of travel), cam 102 is used to control the timing of the departure (clockwise direction of travel).

In the above regard, the distance with which the envelope is pulled out of the hopper 20 is determined by the motion of the rollers 72, and particularly the duration of the time with which the roller 72 move inwardly about pivot point B for engaging the envelope and the duration of time in which the rollers 72 move outwardly therefrom. In this regard, the time during which the rollers 72 travel in a clockwise direction is adjustable utilizing apparatus described above.

It is to be noted that the fact that the segmented rollers 66 rotate twice during a machine cycle (i.e., rotate twice during the deliverly of a single envelope) is particularly advantageous. The 2:1 rotation-to-machine cycle ratio permits the segmented roller 66 to have a smaller diameter, and thus facilitates a more compact hopper structure. In this regard, the relating small diameter roller 66 allows for an appropriate distance between the breaker plate edge 32 and the jaw 52.

While the invention has been particularly shown and described with reference to the preferred embodiments thereof, it will be understood by those skilled in the art that various alterations in form and detail may be made therein without departing from the spirit and scope of the invention.

The embodiment of the invention in which an exclusive property or privielege is claimed are defined as follows:

1. An apparatus for storing a stack of essentially planar articles and for feeding a bottom-most of said articles from said stack, said apparatus comprising:

a plate-like support having an essentially planar surface upon which said stack of articles is at least partially supported;

means for deflecting a portion of said bottom-most article with respect to said planar surface of said plate-like support;

means for temporarily engaging and imparting motion to said deflected bottom-most article, said engaging and motion-imparting means further comprising:

segmented roller means driven to revolve about a first axis, said segmented roller means having an arcuate surface oriented to contact a first surface of said deflected bottom-most article; and, means for cooperating with said segmented roller means, said cooperating means being pivotal about a second axis to selectively move toward and away from contact with a second surface of said deflected bottom-most article;

means for controlling the pivotal motion of said cooperating means about said second axis, said controlling means comprising driven cam means, said driven cam means having a first cam surface with a lobe thereon for controlling with respect to the motion of said segmented roller means the motion of said cooperating means toward contact with said bottom-most article, said driven cam means having a second cam surface with a lobe thereon for controlling with respect to the motion of said segmented roller means the motion of said cooperating means away from contact with said bottom-most article, wherein said cam means comprises a first cam having said first cam surface and a second cam having said second cam surface, said first cam and said second cam being oriented in side-by-side relationship for rotation about a common third axis;

cam follower means adapted to follow said cam means, said cam follower means being adapted to follow whichever of said cams included therein has the greater radial dimension between said cam follower and said third axis;

means for connecting said cam follower means to said cooperating means; and, means for transporting said bottom-most article away from said stack of articles.

2. The apparatus of claim 1, further comprising means for adjusting the angular orientation of a point on said first cam.

3. The apparatus of claim 2, wherein said cam means is rotationally driven about said third axis, said cam means being connected by transmission means to a driving means rotatable about a fourth axis, said means for adjusting the orientation of said first cam about said third axis comprising means for adjusting the angular relationship of a point of said transmission means with respect to said fourth axis.

4. The apparatus of claim 1, further comprising means for adjusting the angular orientation of a point on said second cam about said third axis.

5. The apparatus of claim 4, wherein said means for adjusting the orientation of said second cam about said third axis includes an arcuate channel in said second cam, said arcuate channel being adapted to receive fastener means, said fastener means having a shaft for extending through said arcuate channel and into a receiving aperture in said first cam, said fastener means further having head means for bearing against a side surface of said second cam.

6. The apparatus of claim 1, further comprising:

means for rotationally driving said cam means, said driving means comprising:

primary driving means;

intermediate driving means;

first transmission means connecting said primary driving means to said intermediate driving means; and, second transmission means connecting said intermediate driving means and said cam means; and, means for adjusting the tension of said first transmission means when the position of said overhung edge of said plate-like support is selectively adjusted.

7. An apparatus for storing a stack of essentially planar articles and for feeding a bottom-most of said articles from said stack, said apparatus comprising a plate-like support having an essentially planar surface upon which said stack of articles is at least partially supported;

means for deflecting a portion of said bottom-most article with respect to said planar surface of said plate-like support means;

means for temporarily engaging and imparting motion to said deflected bottom-most article, said engaging and motion-imparting means further comprising:

segmented roller means driven to revolve about a first axis, said segmented roller means having an arcuate surface oriented to contact a first surface of said deflected bottom-most article, wherein said segmented roller means comprises:

bracket means for securing said segmented roller means to said first axis; and, a circular segmented member pibotally connected to said bracket means, said circular segmented member having said arcuate surface thereon; and, means for cooperating with said segmented roller means, said cooperating means being pivotal about a second axis to selectively move toward and away from contact with a second surface of said deflected bottom-most article;

means for controlling the pivotal motion of said cooperating means about said axis; and, means for transporting said bottom-most article away from said stack of articles.

8. The apparatus of claim 7, further comprising means for biasing said circular segmented member with respect to a pivot point at which said circular segmented member is connected to said bracket means.

9. The apparatus of claim 7, wherein said arcuate surface subtends an angle of essentially 75 degrees.

10. An apparatus for storing a stack of essentially planar articles and for feeding a bottom-most of said articles from said stack, said apparatus comprising:

a plate-like support having an essentially planar surface upon which said stack of articles is at least partially supported, said plate-like support having an edge over which said supported articles at least partially overhang;

means for deflecting a portion of said bottom-most article with respect to said planar surface of said plate-like support;

means for temporarily engaging and imparting motion to said deflected bottom-most article, said engaging and motion-imparting means further comprising:

roller means driven to revolve about a first axis, said roller means having an arcuate surface oriented to contact a first surface of said deflected bottom-most article;

means for cooperating with said roller means, said cooperating means being pivotal about a second axis to selectively move toward and away from contact with a second surface of said deflected bottom-most article;

means for transporting said bottom-most article away from said stack of articles;

means for controlling the pivotal motion of said cooperating means about said second axis whereby said cooperating means selectively moves toward said second surface of said deflected bottom-most article for a first time duration and moves away from said second surface of said deflected bottom-most article for a second time duration; and, means for selectively adjusting said control means whereby at least one of said time durations is adjustable for proper reception of said article by said transportation means.

11. The apparatus of claim 10, further comprising a plurality of said means for temporarily engaging and imparting motion to said deflected bottom-most article, said cooperating means of each of said means for temporarily engaging and imparting motion being controlled by said controlling means.

12. The apparatus of claim 10, wherein said support means has mounted thereon stack alignment guide means.

13. The apparatus of claim 10, wherein the positioning of said stack alignment guide means is selectively adjustable whereby said apparatus accommodates articles of differing size.

14. The apparatus of claim 13, wherein said cooperating means comprise freely rotating rollers.

15. The apparatus of claim 10, wherein said deflection means comprise suction means.

16. The apparatus of claim 10, wherein said control means includes cam means, and wherein said apparatus further comprises:

means for rotationally driving said cam means, said driving means comprising:

primary driving means;

intermediate driving means;

first transmission means connecting said primary driving means to said intermediate driving means; and, second transmission means connecting said intermediate driving means and said cam means; and, means for adjusting the tension of said first transmission means when the position of said overhung edge of said plate-like support is selectively adjusted.

17. An apparatus for storing a stack of essentially planar articles and for feeding a bottom-most of said articles from said stack, said apparatus comprising:

a plate-like support having an essentially planar surface upon which said stack of articles is at least partially supported, said plate-like support having an edge over which said supported articles at least partially overhang;

means for deflecting a portion of said bottom-most article with respect to said planar surface of said plate-like support;

means for temporarily engaging and imparting motion to said deflected bottom-most article, said engaging and motion-imparting means further comprising:

roller means driven to revolve about a first axis, said roller means having an arcuate surface oriented to contact a first surface of said deflected bottom-most article;

means for cooperating with said roller means, said cooperating means being pivotal about a second axis to selectively move toward and away from contact with a second surface of said deflected bottom-most article;

means for transporting said bottom-most article away from said stack of articles;

means for controlling the pivotal motion of said cooperating means about said second axis whereby said cooperating means selectively moves toward said second surface of said deflected bottom-most article for a first time duration and moves away from said second surface of said deflected bottom-most article for a second time duration;

means for moving said plate-like support whereby the position of said overhung edge is selectively adjusted with respect to said transportation means; and, means for selectively adjusting said control means whereby at least one of said time durations is adjustable in accordance with the selective positioning of said overhung edge of said plate-like support relative to said transportation means.

18. A method of operating an apparatus from which essentially planar articles are fed, said method comprising the steps of:

(1) stacking an article of a first size in a hopper by placing said article on an essentially planar support surface comprising said hopper, said planar support surface having an edge over which said supported article is at least partially overhung;

(2) deflecting a portion of said article with respect to said support surface;

(3) temporarily engaging and imparting motion to said deflected article, said engaging and motion-imparting step further comprising:

using roller means driven to revolve about a first axis, said roller means having an arcuate surface oriented to contact a first surface of said deflected article; and, using means for cooperating with said segmented roller means, said cooperating means being pivotal about a second axis to selectively move toward and away from contact with a second surface of said deflected article;

(4) controlling the pivotal motion of said cooperating means about said second axis, whereby said cooperating means selectively moves toward said second surface of said deflected article for a first time duration and moves away from said second surface of said deflected article for a second time duration;

(5) transporting said motion-imparted article away from said hopper;

(6) stacking an article of a second size in said hopper;

(7) adjusting said control means whereby at least one of said time durations is adjusted for proper reception of said article of said second size by said transportation means; and, (8) repeating at least steps (2) through (5) with respect to said article of said second size.

19. The method of claim 18, further comprising the step of:

selectively moving said support surface whereby the position of said overhung edge is selectively adjusted with respect to said transportation means, said adjusted position being chosen for proper reception of said article of said second size by said transportation means.

20. The method of claim 18, wherein said step of deflecting a portion of said article includes applying suction to said article.

21. The method of claim 18, wherein said step of adjusting said control means includes the step of adjusting the extent of travel of a follower roller upon first and second cam surfaces, said follower being connected to said cooperating means.

* * * * *

UNITED STATES PATENT AND TRADEMARK OFFICE

CERTIFICATE OF CORRECTION

PATENT NO. : 4,580,772

DATED : April 8, 1986

INVENTOR(S) : Warren D. Reinert

It is certified that error appears in the above-identified patent and that said Letters Patent is hereby corrected as shown below:

Column 17, line 1, delete "segmented".

Signed and Sealed this

Thirtieth Day of December, 1986

*Attest:*

DONALD J. QUIGG

*Attesting Officer*

*Commissioner of Patents and Trademarks*